United States Patent [19]

Arlt et al.

[11] Patent Number: 4,567,840

[45] Date of Patent: Feb. 4, 1986

[54] CLOSURE FOR A CHAIN ENTRY APERTURE

[75] Inventors: Edward J. Arlt; L. Blake Whitley, both of Arlington, Tex.

[73] Assignee: LTV Energy Products Company, Dallas, Tex.

[21] Appl. No.: 509,365

[22] Filed: Jun. 30, 1983

[51] Int. Cl.[4] ..... B63B 21/18

[52] U.S. Cl. ..... 114/180; 24/116 R

[58] Field of Search ..... 114/173–181, 114/199, 200, 210, 202; 49/40, 170, 370, 475, 477; 24/116 R

[56] References Cited

U.S. PATENT DOCUMENTS

| | | | |
|---|---|---|---|
| 2,555,696 | 6/1951 | Krogstad et al. | 114/180 |
| 2,652,018 | 9/1953 | Griffith | 24/116 R |
| 2,994,291 | 8/1961 | Angell | 114/200 |
| 3,386,203 | 6/1968 | Butler et al. | 49/210 |
| 3,386,206 | 6/1968 | Loveless | 49/221 |
| 3,530,925 | 9/1970 | Miller | 160/180 |
| 3,718,231 | 2/1973 | O'Connor | 220/41 |

FOREIGN PATENT DOCUMENTS

| | | | |
|---|---|---|---|
| 48211 | 11/1982 | Japan | 114/180 |
| 471238 | 8/1975 | U.S.S.R. | 114/180 |

*Primary Examiner*—Galen L. Barefoot
*Assistant Examiner*—Stephen P. Avila
*Attorney, Agent, or Firm*—Arnold, White & Durkee

[57] ABSTRACT

A closure for a chain entry aperture in which two or more seal blocks of a suitable elastomeric material are slidable between a position in which the aperture is open, and a position in which the seal blocks cooperate to close the aperture and seal around a chain extending through the aperture. Contact surfaces of the seal blocks are shaped to accommodate the chain passing through the aperture when the seal blocks are in the closed position.

3 Claims, 6 Drawing Figures

CLOSURE FOR A CHAIN ENTRY APERTURE

BACKGROUND OF THE INVENTION

This invention relates to a closure for an aperture through which a chain passes and in particular to a closure for hawseholes on offshore drilling rigs.

Offshore drilling rigs are generally anchored to the sea floor by one or more anchors which are connected to heavy anchor chains. These chains generally pass up the outside of the rig to a winch which is located on the deck of the rig platform. The free end of the chain then passes through an opening in the deck, the hawsehole, which may be formed by a length of pipe called the hawse pipe, to a chain locker below the deck.

Heavy seas or structural failure can cause water to wash into the chain locker through this opening. In some intances, so much water may enter the locker that there is a significant shift in the center of gravity of the rig, causing instability which increases the risk of capsizing.

The traditional solution to this problem used on ships was the hawse bag, a bag of canvas or tarpaulin stuffed with wood chips or similar material which was stuffed into the hawsehole around the chain in heavy weather. This bag had obvious disadvantages; they were heavy and cumbersome to handle even in good conditions and tended to become soaked during prolonged storms. A modern equivalent is an air bag of rubber or a similar material, but this is still difficult to handle, especially in adverse conditions, and a puncture would render it useless or at least considerably diminish its effectiveness.

Another method of closure is a solid, two piece plug, which is installed in the hawsehole on either side of the chain. This plug has several disadvantages. It is heavy, difficult to install accurately, and the chain tends to slip through it unless the tension on the chain is reduced. If the plug is not installed accurately, its sealing ability is reduced and water can enter the chain locker.

SUMMARY OF THE INVENTION

The above noted and other disadvantages of the prior art are overcome by the chain locker closure of this invention.

In one embodiment of the invention, there is disclosed an enclosure for a chain entry aperture comprising a pair of opposed seal blocks of a suitable elastomeric material. Each seal block has a contact surface contoured to be sealing engageable with a portion of the chain extending through the aperture, and at least one seal block is reciprocatingly slidable in a plane parallel to the plane of the aperature between a position in which the aperture is open and a position in which the seal blocks cooperate to close the aperture and seal around the chain extending through the aperture.

In another embodiment of the invention, the closure for the chain entry aperture further has means for moving the seal blocks between the open and closed positions and means for maintaining the seal blocks in sealing contact with each other and the chain when in the closed position.

In a further embodiment of the invention, the moving and maintaining means comprise hydraulic presssure acting on each seal block.

In yet another embodiment of the invention, the seal blocks slide between the open and closed positions on parallel spaced guide rails which lie in a plane parallel to the plane of the chain entry aperture.

In still a further embodiment of the invention, a circumferential sealing edge extends around the chain entry aperture. A downward facing sealing face on each seal block is sealingly engageable with the circumferential edge when the seal blocks are in the closed position.

In yet another embodiment of the invention, there is provided a seal block of a suitable elastomeric material for use in a chain entry aperture closure of type formed by a pair of seal blocks at least one of which is reciprocatingly slidable in a plane parallel to the plane of the aperture between a position in which the aperture is open and a position in which the seal blocks cooperate to close the aperture and seal around the chain extending through the aperture. The seal block has a contact surface which is contoured to accommodate the chain.

It is therefore an advantage of the present invention that a substantially watertight seal for a chain entry aperture is provided.

Another advantage is that the aperture may be remotely closed without need for human handling. This is a particularly important advantage in applications such as use on offshore drilling rigs in the North Sea and other areas where severe weather conditions are encountered.

A further advantage is that the closure is relatively simple in design, decreasing the need for frequent maintenance.

Still another advantage is that the seal blocks of the closure are easily removed when replacement is necessary.

DESCRIPTION OF THE PREFERRED EMBODIMENT

Figure 1:
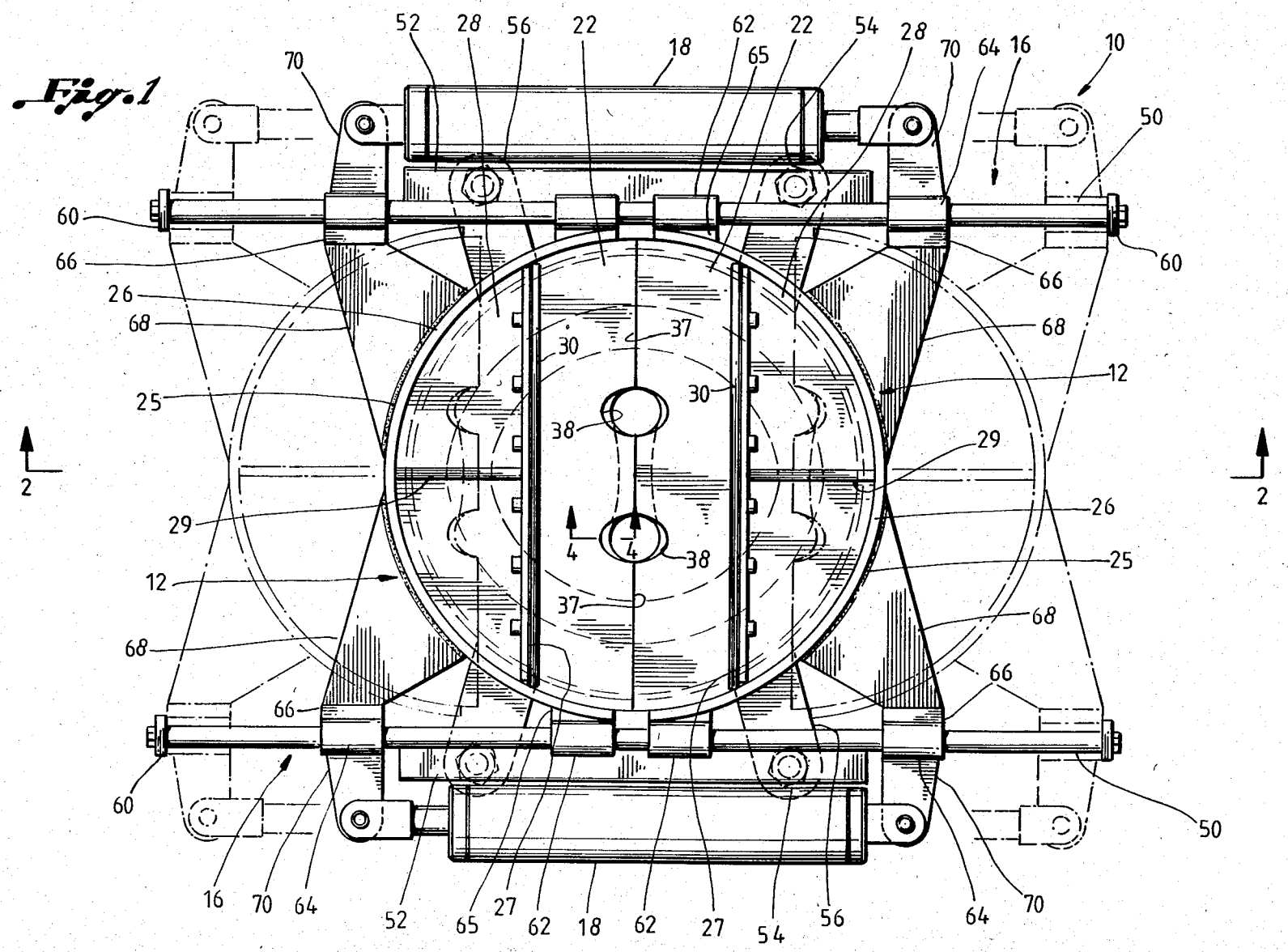
FIG. 1 is a plan view of a chain locker seal according to the present invention shown in the closed and sealed position with the open position shown in phantom.
Figure 2:
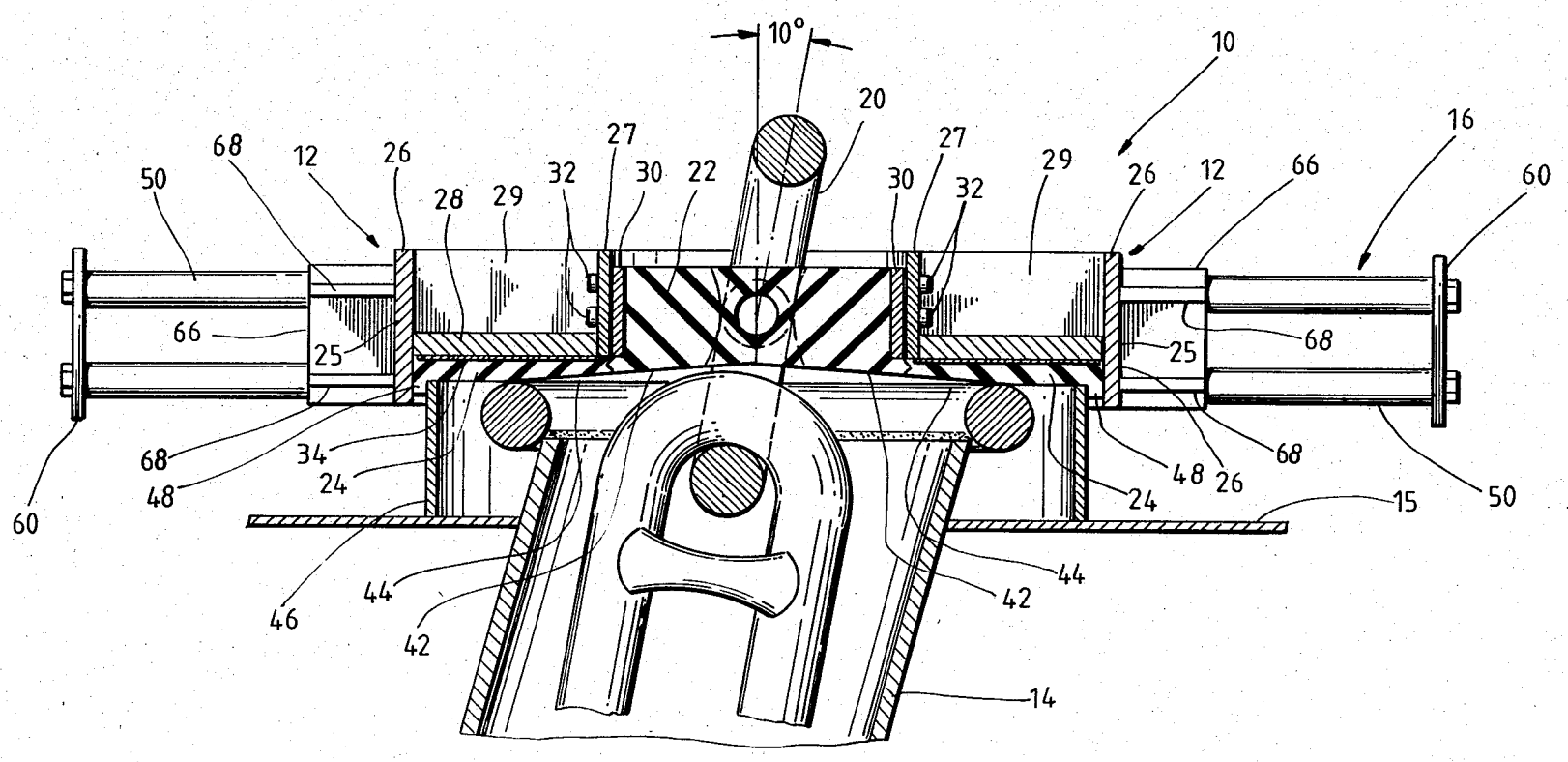
FIG. 2 is a vertical section through the chain locker seal along line 2—2 of FIG. 1 showing the sealing blocks in sealing engagement with an anchor chain.

Referring first to FIGS. 1 and 2, there is shown a chain locker seal 10 in accordance with the present invention. Chain locker seal 10 generally has a pair of opposed sealing members 12 which may be reciprocated across the opening of a hawsehole 14 in a drilling rig deck 15 along parallel guide rails 16 by a pair of double action hydraulic cylinders 18. In the closed position, shown in solid lines in FIG. 1, the chain locker seal sealingly engages a chain 20 extending into hawsehole 14, thereby preventing water from entering the hawsehole.

Each seal member 12 has a primary elastometric seal block 22 and a secondary elastometric seal block 24. Seal blocks 22, 24 are housed in a pair of opposed frames 25. Each frame has a circumferential plate 26, a transverse mounting plate 27, a horizontal mounting plate 28, and a stiffing plate 29. Stiffing plate 29 acts as a backup to stiffen transverse mounting plate 27 against horizontal forces produced in creating a tight seal around the chain when sealing members 12 are brought into a closed position.

Figure 5:
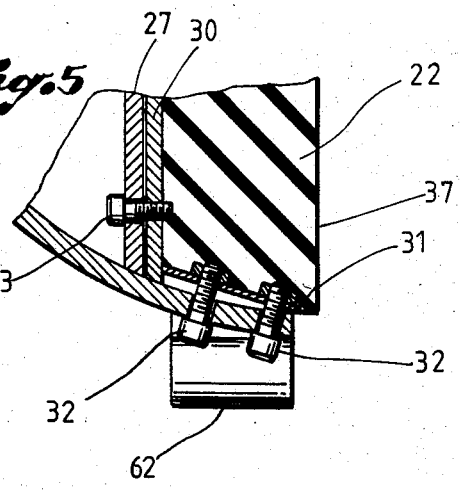
FIG. 5 is an enlarged plan view of a primary seal block showing the screw connection between a circumferential plate and the seal block.

It is desirable that the seal blocks be easily removed from frame 25 so that when a seal block wears out, it can be replaced without removing the entire assembly from the hawsehole. This is preferably accomplished by the screw connections shown in FIGS. 3 and 5.

Each primary seal block 22 is vulcanized to a transverse support plate 30. This is accomplished as follows. Plate 30 is first carefully cleaned using well known techniques including sand blasting and application of trichlorethylene. A suitable primer and a bonding agent are then applied, and plate 30 is placed in the mold along with the elastomeric material of which the seal block is formed. The elastomeric material is then vulcanized, and the bonding agent permits bonding between seal block 22 and transverse support plate 30.

During the molding process, each primary seal block 22 has molded into it adjacent each of its sides a lateral support plate 31. The primary seal blocks are then fastened to circumferential plates 26 and transverse plates 27 by screws 32, 33, respectively threaded into plates 31, 30. A gasket 34 is preferably inserted between transverse support plate 30 and transverse mounting plate 27 to prevent water from seeping down between the plates.

Likewise, each secondary seal block 24 is vulcanized to a horizontal support plate 35 using the process generally described above. The secondary seal blocks are then fastened to horizontal mounting plates 28 by screws 36, which are countersunk into the secondary seal blocks.

Figure 6:
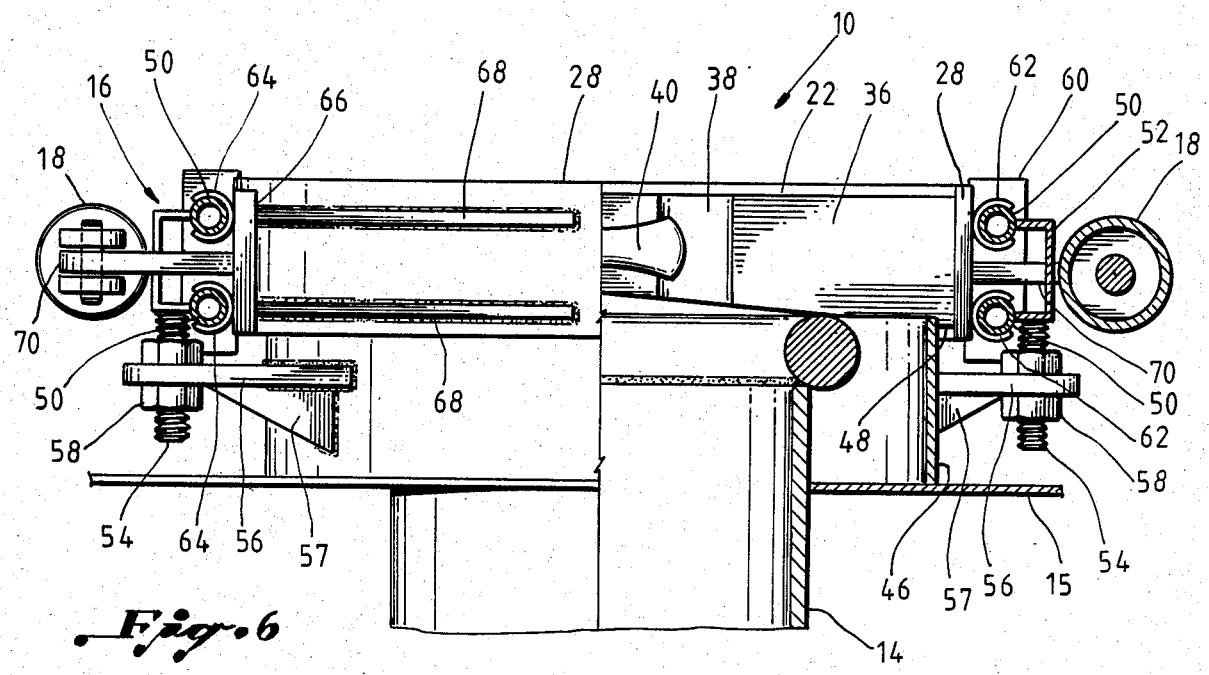
FIG. 6 is a vertical end view in partial section of the chain locker seal according to the invention.
Figure 3:
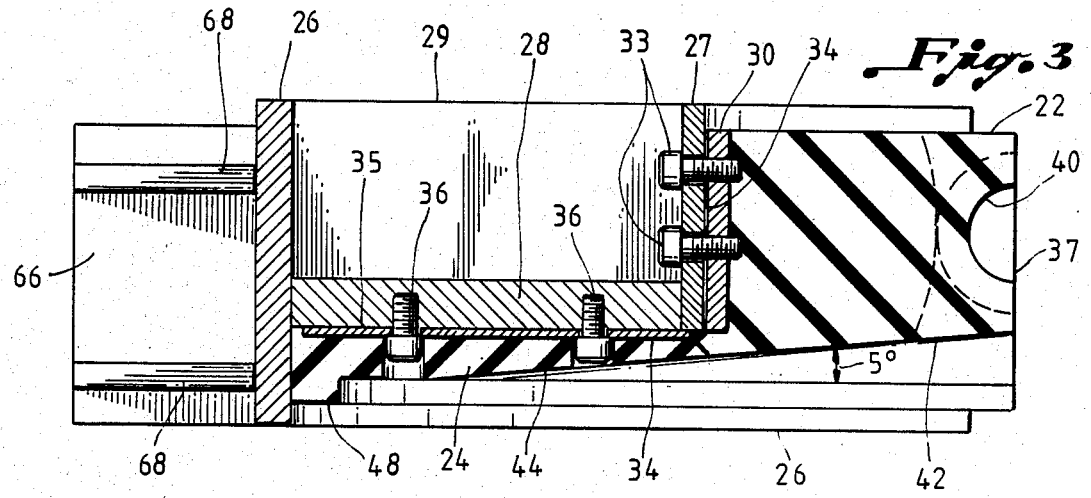
FIG. 3 is a detail of the vertical section of FIG. 2 showing a seal block of the chain locker seal according to the invention.
Figure 4:
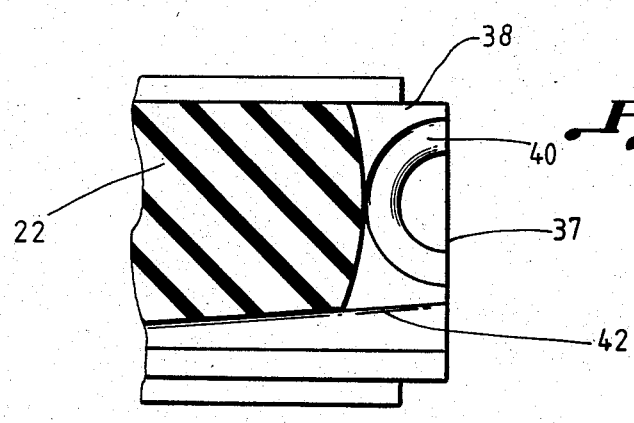
FIG. 4 is a detail sectional view taken along line 4—4 of FIG. 1 showing the chain engagement area of a seal block.

As shown in FIGS. 1 and 6 each primary seal block 22 has a contact face 37 profiled to contact a like contact face on the opposed seal block and to sealingly engage a link of an anchor chain 20 extending through the hawse pipe opening. Each contact face 37 has a pair of vertical cutouts 38 to receive the ring portion of a chain link. As best seen in FIGS. 3 and 4, vertical cutouts 38 are preferably tapered outwardly toward the top and bottom in order to accommodate a chain link extending through the hawse pipe as much as 10° out of the vertical. A horizontal cutout 40 extending between vertical cutouts 38 is profiled to receive the stud of a chain link.

As best seen in FIGS. 2 and 3, primary seal block 22 has a tapered bottom surface 42 and secondary seal block 24 has a corresponding tapered bottom surface 44. This taper, preferrably at about 5°, permits the seal members to slide easily over the hawsehole opening and also over the upper edge of circumferential pipe 46 which is welded to deck 15. The seal blocks also have a downwardly depending lip 48 that engages circumferential pipe 46 to prevent water from entering the hawsehole between chain locker seal 10 and the hawsehole. As sealing members 12 move from the open to the closed position, the tapered bottom surfaces 42, 44 provide an increasingly tighter seal on circumferential pipe 46 until a tight seal is obtained between circumferential pipe 46 and lip 48 and bottom surfaces 42, 44 of the seal blocks when the chain locker seal is closed.

To create an adequately tight seal at the critical sealing areas, that is around chain 20, between contact faces 37, and between bottom surfaces 42, 44 and pipe 48, it is desirable that seal blocks 22, 24 deform or crush slightly adjacent these seal areas. Yet, the seal blocks must be capable of withstanding the compressive forces produced upon closure of the chain locker seal. A suitable elastomeric material for accomplishing this is a nitrile or neoprene elastomer having an ASTM durometer hardness in the range of 50–80. Primary and secondary seal blocks 22, 24 may be formed of this material or, if desired, this material may be used adjacent the critical sealing areas with the remainder of the seal blocks being composed of a harder material.

Referring now to FIGS. 1, 2 and 6, guide rails 16 comprise elongated rods 50 rigidly attached to a channel section 52, preferably by welding. Channel section 52 is in turn welded at its bottom flange to a pair of vertical threaded rods 54. Each threaded rod extends through an aperture in a lug 56 which extends horizontally from circumferential pipe 46. Each lug 56 is stiffened by a triangular gusset plate 57 welded to its underside and to pipe 46. A pair of adjustment bolts 58 threadably engage each rod 54 on opposed sides of horizontal lugs 56, permitting guide rails 16 to be adjusted vertically upwardly or downwardly and to be fixed in a position which provides a tight seal between secondary seal blocks 24 and circumferential pipe 46.

Each pair of elongated rods 50 has a stop plate 60 bolted to each end thereof. Stop plates 60 serve two functions. First, they prevent sealing members 12 from moving beyond the ends of the guide rails. Second, they provide spacing and stiffening for elongated rods 50.

As shown in FIGS. 1 and 6, each sealing member 12 has a partially circular inner sleeve 62 and a partially circular outer sleeve 64 slidably engaging each elongated rod 50. Each inner sleeve 62 is attached to circumferential plate 26 by a plate 65. Each vertically spaced pair of outer sleeves 64 is connected to a vertical spacer plate 66 which is in turn welded to a pair of extension plates 68 hortizonally projecting from circumferential plate 26.

Each double action hydraulic cylinder 18 is pin connected at each of its opposed ends to a cylinder lug 70 which is centrally welded to spacer plate 66. The double action cylinders reciprocate sealing members 12 between the open and closed positions and also retain the sealing members in tight sealing engagement with a chain by application of a constant hydraulic pressure to the cylinders. During reciprocation, inner and outer sleeves 62, 64 slide along rods 50. Eight inch cylinders are adequate to provide a sufficient sealing force.

For economical fabrication, the non-elastomic hardware, including the various plates, gussets, lugs and channels, can be made of ASME A36 steel.

The foregoing description has been directed to a particular embodiment of the invention in accordance with the requirements of the patent statutes for the purposes of illustration and explanation. It will be apparent, however, to those skilled in this art that many modifications and changes in the apparatus set forth will be possible without departing from the scope and spirit of the invention. It is intended that the following claims be intrepretated to embrace all such modifications and changes.

What is claimed is:

1. A closure for a chain entry aperture comprising:

a. a pair of opposed seal blocks each having a contact surface of a suitable elastomeric material contoured to be sealingly engageable with a portion of any link of a chain extending through the aperture, each contact surface having a central portion extending between the ring portion of the link;

b. two parallel guide rails positioned on opposed sides of the chain entry aperture and in a plane parallel to the plane of the chain entry aperture on which the seal blocks slide in a plane parallel to the plane of the aperture between a position in which the aperture is open and a position in which the seal blocks contact each other and a portion of any chain link to create a continuous, solid, sealed surface across the chain entry aperture to close the aperture and seal around the chain link extending through the aperture;

c. hydraulic pressure applied to each seal block to move the seal blocks between the open and closed positions and to maintain the seal blocks in the closed position and to create the continuous, solid, sealed surface across the aperture;

d. a circumferential sealing edge extending around the chain entry aperture; and e. a downward facing sealing face on each seal block, each downward facing sealing face being sealingly engageable with the circumferential sealing edge when the seal blocks are in the closed position, each sealing face being tapered to be thinner at its inner end than its outer end to permit easy sliding over the circumferential sealing edge.

2. A closure for chain entry aperture comprising a pair of opposed seal blocks, each seal block having a contact surface of a suitable elastomeric material contoured to contact each other to close the aperture and to be sealingly engageable with a portion of any link of a chain extending through the aperture when the seal blocks are in contact with other to close the aperture, the contact surfaces each having a central portion contacting each other inside the ring portion of the chain link, the seal blocks contacting each other and a portion of the chain link to form a solid plane sealing and closing the chain entry aperture, at least one seal block being reciprocatingly slidable in a plane parallel to the plane of the aperture between a position in which the aperture is open and a position in which the seal blocks are in contact with one another and a portion of the chain link to form a solid plane and to close the aperture, and a separate second elastomeric block located on the lower surface of each seal block and a circumferential sealing edge extending around the chain entry aperture, the separate blocks being positioned to contact and seal against the circumferential sealing edge when the seal blocks are in the closed position.

3. A closure for a chain entry aperture according to claim 2 wherein each second elastomeric block is tapered to be thinner at its inner end than at its outer end to permit them to slide over the circumferential sealing edge.

* * * * *